US006820434B1

(12) United States Patent
Gutheim et al.

(10) Patent No.: US 6,820,434 B1
(45) Date of Patent: Nov. 23, 2004

(54) REFRIGERANT COMPRESSION SYSTEM WITH SELECTIVE SUBCOOLING

(75) Inventors: August W. Gutheim, Chittenango, NY (US); L. Thomas Lane, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/619,242

(22) Filed: Jul. 14, 2003

(51) Int. Cl.[7] ..... F25B 7/00; F25B 41/00
(52) U.S. Cl. ..... 62/175; 62/510; 62/513
(58) Field of Search ..... 62/513, 113, 510, 62/117, 200, 175, 199, 204, 224

(56) References Cited

U.S. PATENT DOCUMENTS 4,696,168 A * 9/1987 Woods et al. ..... 62/200
5,095,712 A * 3/1992 Narreau ..... 62/113
5,577,390 A * 11/1996 Kaido et al. ..... 62/228.5
5,626,027 A * 5/1997 Dormer et al. ..... 62/175
5,768,901 A * 6/1998 Dormer et al. ..... 62/175
6,058,729 A * 5/2000 Lifson et al. ..... 62/217
6,167,722 B1 * 1/2001 Kasezawa et al. ..... 62/513
6,189,335 B1 * 2/2001 Ebara et al. ..... 62/510
6,374,631 B1 * 4/2002 Lifson et al. ..... 62/505
6,385,981 B1 * 5/2002 Vaisman ..... 62/196.3
6,474,087 B1 * 11/2002 Lifson ..... 62/199

* cited by examiner

*Primary Examiner*—Marc Norman
(74) *Attorney, Agent, or Firm*—Wall Marjama & Bilinski LLP

(57) ABSTRACT

The compressor of a transport refrigeration system is divided into two sections, with each section having a suction inlet. The refrigerant vapor from the evaporator is passed to one of the suction inlets, whereas the refrigerant vapor from a subcooler circuit is passed to the other suction inlet. A valve is operated to selectively insert or remove the subcooler as capacity requirements vary. In one embodiment, a six cylinder reciprocating compressor is used with five cylinders compressing within a first section, and a single cylinder compressing in the other section containing the subcooler circuit.

17 Claims, 3 Drawing Sheets

REFRIGERANT COMPRESSION SYSTEM WITH SELECTIVE SUBCOOLING

BACKGROUND OF THE INVENTION

This invention relates generally to vapor compression refrigeration systems and, more particularly, to a method and apparatus for subcooling refrigerant in a transport refrigeration system.

In many refrigeration systems, such as those for preserving food in supermarkets, refrigerators and the like, the load is substantially fixed and the demands of the system are substantially constant throughout the life of the system.

Transport refrigeration systems are different. As the types of food products that are being transported in refrigerated trucks, trailers and containers are always changing, the temperatures at which these products are desirably maintained also change. For example, one day the cargo of a truck may be bananas, with the desired temperature to be maintained at 57° degrees. On the next day, the same trailer may be hauling frozen goods, and the desired temperature to be maintained in the trailer would be 0° F. or below. They also must be able to operate in all ambient conditions as they are portable and need to be able to operate all over the world. Because of this wide range of demands, the design of a refrigeration system for a transport truck/trailer must therefore be very flexible. Thus, they must be designed to meet the maximum capacity requirements, but they are preferably designed to operate efficiently and precisely at much lower capacity requirements during most of their operating life.

Various marketing conditions have tended to exacerbate the problems of meeting the capacity requirements of transport refrigeration systems as discussed hereinabove. For example, because of environmental concerns, it has become necessary to abandon the use of more efficient, but environmentally undesirable, refrigerants, and to replace them with refrigerants that are less efficient. Another development that has occurred because of the need for greater cargo capacity and overall efficiencies, is a tendency to lengthen the refrigerated trailers, and also construct them with thinner side walls.

Current single stage compression systems have limited capacity and cannot meet the market needs as discussed hereinabove. The use of subcooling and refrigeration systems has long been used but the systems have generally been relatively complex, expensive, and difficult to maintain. Examples of such systems include those with suction liquid heat exchangers, subcoolers in condenser coils, and mechanical subcoolers using separate compressors or economizer subcoolers in multi-compressor staged systems.

It is therefore an object of the present invention to provide an improved transport refrigeration system.

Another object of the present invention is the provision in a transport refrigeration system to selectively operate at higher capacity levels in an easy to use and efficient manner.

Yet another object of the present invention is the provision in a transport refrigeration system for operating at a lower capacity level in a reliable and efficient manner.

Still another object of the present invention is the provision for transport refrigeration systems which can be readily and easily boosted in its output capacity.

Yet another object of the present invention is the provision for a transport refrigeration system which is economical to manufacture and effective and efficient in use.

These objects and other features and advantages become more readily apparent upon reference to the following description when taken in conjunction with the appended drawings.

SUMMARY OF THE INVENTION

Briefly, and in accordance with an aspect of the invention, a single compressor of a transport refrigeration system is provided with two sections, with one section being connected to the main system evaporator, and the other section being connected to a subcooling evaporator. An isolation valve and an expansion device are in the subcooler unit so as to allow for control and isolation of the subcooler when not required.

In accordance with another aspect of the invention, a multiple cylinder reciprocal compressor is provided with one or more cylinders being dedicated to use in the subcooler circuit, while the other cylinders are dedicated to the main evaporator circuit.

By yet another aspect of the invention, one or more unloading circuits are provided in the main section of the compression system such that the compressor can be unloaded during periods of low capacity demand.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
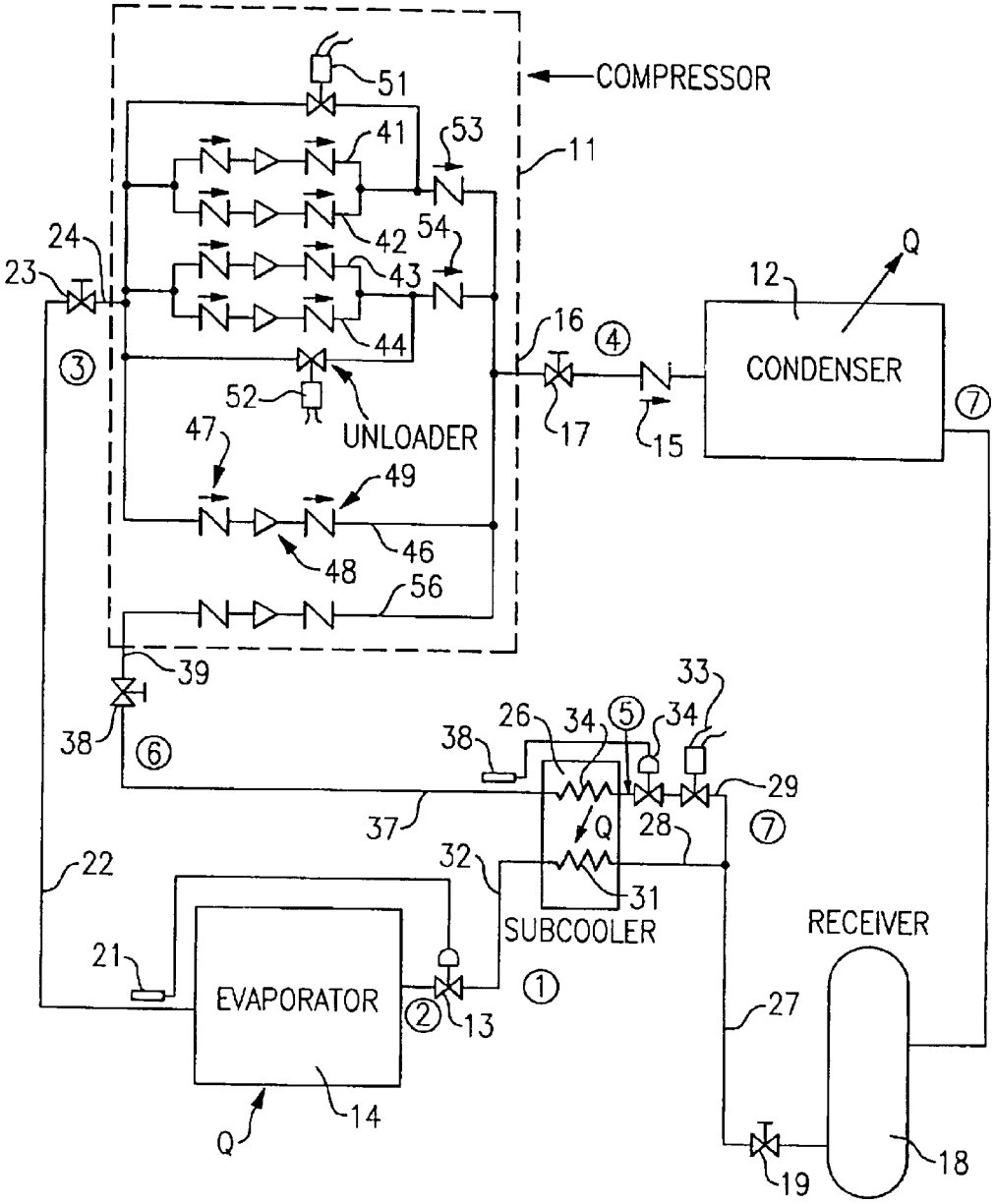
FIG. 1 is a schematic illustration of a refrigeration system in accordance with a preferred embodiment of the invention.

Referring now to FIG. 1, a vapor compression system for use in a transport refrigeration system, such as a refrigerated truck, trailer or container is shown to include a compressor 11 (shown generally in dashed lines), a condenser 12, an expansion device 13 and an evaporator 14, which are connected within a closed circuit to be operated in a conventional manner.

The compressor discharge port 16 is connected to discharge to the condenser 12 by way of the valve 17, which can be selectively opened or closed for the purpose of isolating the compressor for service, and by the discharge check valve 15. Downstream of the condenser 12, a receiver 18 and an associated valve 19 may be included.

Expansion valve 13 is placed just upstream of the evaporator 14 and is responsive to a sensor 21 that senses the temperature of the refrigerant at the downstream end of the evaporator 14 so as to maintain a slightly superheated refrigerant condition. The superheated refrigerant then flows along the line 22 through a valve 23 to a compressor suction inlet 24. The compressor suction inlet 24 is one of two compressor suction inlets as will be described hereinafter.

In order to obtain greater capacity from the compressor 11, a subcooler 26 is provided upstream of the evaporator 14. Upstream of the subcooler 26, a line 27 divides into lines 28 and 29, with line 28 passing through the subcooler 26 by way of the heat exchanger element 31 and then by way of line 32 to the expansion device 13. A line 29 is fluidly interconnected to a valve 33, a second expansion valve 34, a heat exchanger element 36 and out to line 37. A sensor 38 is interconnected to the expansion valve 34 so as to allow the expansion valve 34 to be responsive to the temperature of the refrigerant leaving the subcooler 26. Line 37 is connected by way of valve 38 to another compressor suction inlet 39 as shown.

In operation, during periods in which the system demand calls for relatively low capacities, the valve 33 is in the closed position and the subcooler 26 is effectively removed from the circuit. The refrigerant flows through lines 27, 28, and through the heat exchanger element 31, to the line 32 and the expansion valve 13. Downstream of the evaporator 14, the refrigerant passes into the compressor suction inlet 34, is compressed in a manner as will be described hereinafter, and is discharged at the compressor discharge port 16.

During periods of operation wherein greater capacities are required, the valve 33 is opened to allow the flow of refrigerant through line 29, the valve 33, the expansion valve 34, and into the heat exchanger element 36. Because of the expansion of the refrigerant in the expansion valve 34, the heat exchange element 34 is cooled, but with the heat exchanger element 36 being in heat exchange relationship with the heat exchanger element 31, the transfer of heat causes a cooling of the refrigerant flowing through the heat exchanger element 31, such that the temperature of the refrigerant entering the expansion valve 13 is subcooled. As the subcooled refrigerant passes into the evaporator, it results in a substantially greater performance of the evaporator 14.

Considering in greater detail the compressor 11, it will be seen that the compressor 11 is a multiple cylinder reciprocating compressor. Five of the six cylinders are interconnected to provide compression between the suction inlet 24 and the discharge port 16. These are shown at 41–46. Each of the cylinders has a suction valve 47, a piston 48 and a discharge valve 49 as shown. A pair of unloaders 51 and 52 are provided to selectively connect the high pressure side back to suction as shown in order to reduce the capacity when it is not needed. Check valves 53 and 54 are also preferably provided on the high pressure side as shown.

Referring now to the sixth cylinder 56, this cylinder provides compression between the compressor suction inlet 39 and the compressor discharge port 16. It is identical to the other cylinders in that it has a suction valve 47, a piston 48 and a discharge valve 49, but it may well have a different displacement than the other cylinders. During periods in which the subcooler is activated within the system by the opening of the isolation valve 33, the cylinder 56 will compress the refrigerant being discharged from the subcooler 26, with the compressed refrigerant being mixed with that compressed by the other five cylinders of the compressor 11. During periods in which the additional capacity is not required, the isolation valve 33 will be closed and the cylinder 56 will continue to function but will not perform any work. The isolation valve 33 could be integrated with the expansion device 34 by use of an electronic expansion valve as will be more fully discussed hereinafter.

When full capacity is required, all six cylinders will be compressing refrigerant and the evaporator unit will be boosted by use of the subcooled refrigerant. When fall capacity is not required, it may be reduced by turning off the subcooler or partially closing down the subcooler 26, or by using one or both of the unloaders 51 and 52, or a combination of these approaches.

Figure 2:
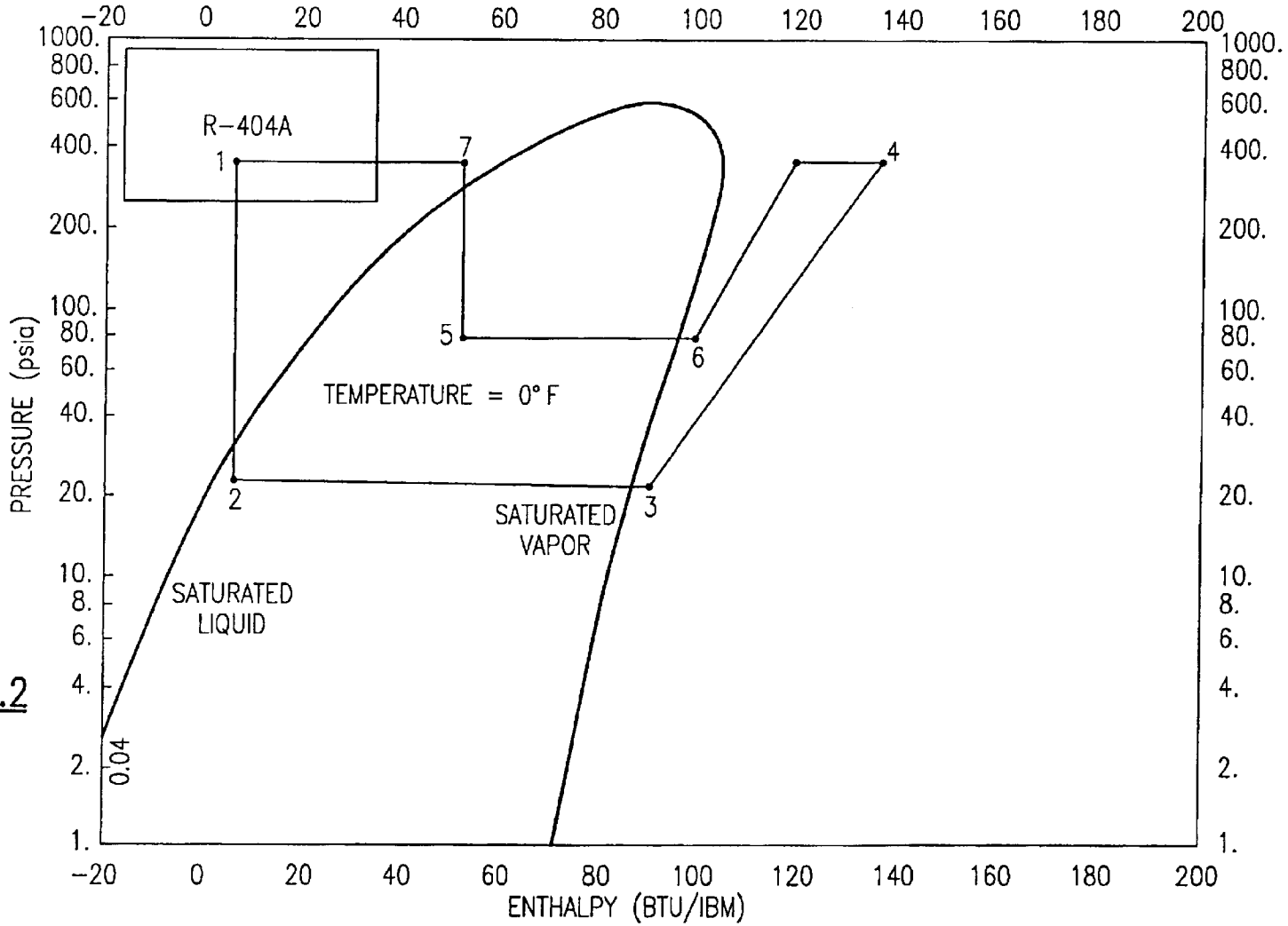
FIG. 2 is a graphic illustration of the pH diagram of the cycle of that system.

Referring now to FIG. 2, the pH diagram of the system is shown when using R-404A as the refrigerant. The points 1–7 represent the positions on the chart which corresponds with the positions 1–7 within the system cycle as shown in FIG. 1.

At point 1, upstream of the expansion valve 13, the refrigerant is at a relatively high pressure and low temperature. At point 2, just downstream of the expansion valve 13, the pressure is substantially reduced, and at point 3, just upstream of the compressor suction inlet 24, the pressure is relatively low and the temperature is substantially increased. After passing through the compressor, the temperature and pressure are increased to point 4 and after passing through the condenser at position 7, the pressure remains almost constant but the temperature is substantially reduced. Finally, passing of the refrigerant along line 28 and through the subcooler 26 cools the refrigerant to the point 1 temperature.

Considering now what occurs in the other line 29 of the subcooler 26, the passing of the refrigerant through the expansion valve 34 reduces the pressure to that at point 5, and after passing through the subcooler 26 the temperature of that refrigerant is increased to that shown at point 6.

Figure 3:
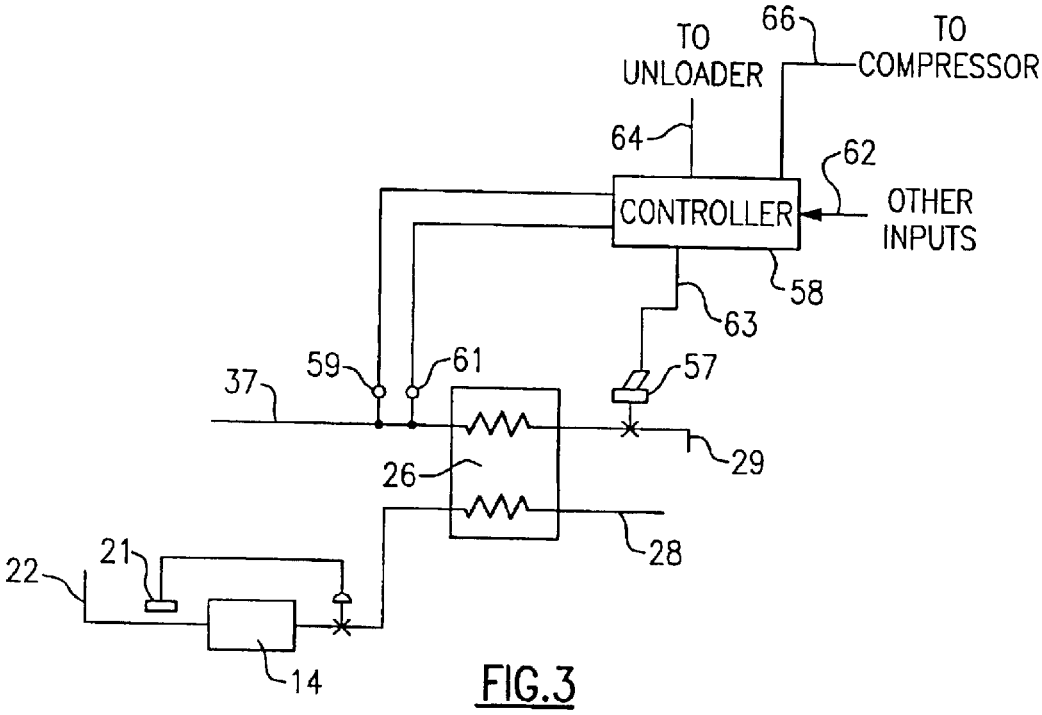
FIG. 3 is a schematic illustration of an alternate embodiment of the invention.

Referring now to FIG. 3, an alternative embodiment is shown wherein the isolation valve 33 and the expansion valve 34 are replaced with an electronic expansion device 57 upstream of the subcooler 26 as shown. The electronic expansion device 57 is controlled by a controller 58 which automatically adjusts the electronic expansion device 57 toward the closed or open conditions in response to various sensed and programmed parameters.

On the downstream side of the subcooler 26, the sensors 59 and 61 sense pressure and temperature, respectively, of the refrigerant in lines 37 and input those values to the controller 58. Other inputs, such as saturation point, ambient temperature, suction pressure and discharge pressure, are input into the controller 58 by way of line 62.

In response to the various input signals and the programmed software embedded therein, the controller sends signals along lines 63, 64 and 66 to control the electronic expansion device 57, the unloading function, and the compressor speed, respectively, in order to optimize the system operation in a controlled and efficient manner.

Figure 4:
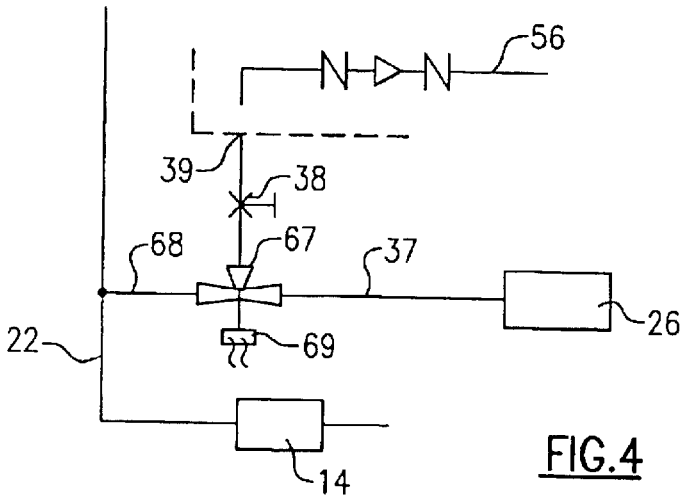
FIG. 4 is a schematic illustration of yet another embodiment of the invention.

Another embodiment of the present invention is shown in FIG. 4 wherein, a three way valve 67 is provided in line 37 and ties into line 22 by way of line 68. The three way valve 67, which can be controlled by solenoid 69, would enable the six cylinder 56 to be able to use suction gas from line 37 as described hereinabove, but it also can be used to bring in suction gas from line 22, along line 68, to thereby permit the compressor to act as a full six cylinder machine on gas from the evaporator 14, or as a subcooling cylinder as described hereinabove. One advantage of this arrangement is that the subcooler 26, and all joints up to the compressor suction valve 38, would not be under negative pressure when shut off. A possible disadvantage is the need for a three way valve, which is generally not considered to be particularly reliable.

While the present invention has been particularly shown and described with reference to a preferred embodiment as illustrated in the drawings, it will be understood by one skilled in the art that various changes in detail may be effected therein without departing from the true spirit and scope of the invention as defined by the claims. For example, although the compressor has been described in terms of a six cylinder reciprocating compressor with five cylinders dedicated to one section and one cylinder to the other section, it may just as well be separated at different ratios, such as four and two, or it may have a different number of cylinders, such as one and one in a two cylinder machine, or three and one in a four cylinder machine, for example.

We claim:

1. A vapor compression system comprising:

a single stage compressor having first and second sections connected in parallel with each having a suction inlet and both discharging to a single discharge port;

a condenser for receiving high pressure vapor from said discharge port and converting at least a portion thereof to a lower temperature liquid;

an expansion device for receiving said liquid and expanding it to a lower pressure vapor;

an evaporator for receiving said lower pressure vapor at a low temperature and delivering it to said first section at a higher temperature; and a subcooler for receiving a portion of said liquid refrigerant from said condenser to subcool another portion of said liquid refrigerant passing from said condenser to said expansion valve, said subcooler being fluidly connected to second section of said compressor.

2. A compression system as set forth in claim 1 wherein said compressor is a multi-cylinder compressor and each of said two sections is driven by separate cylinder groups.

3. A vapor compression system as set forth in claim 2 wherein one section is driven by a plurality of cylinders and another section is driven by a single cylinder.

4. A compression system as set forth in claim 3 wherein a circuit containing said subcooler is driven by a single cylinder.

5. A compression system as set forth in claim 1 and including unloading circuits in at least one section to fluidly interconnect a high pressure side to a low pressure side of said compressor.

6. A compression system as set forth in claim 1 wherein said subcooler has associated therewith an isolation valve which may be closed to effectively remove the subcooler from operation.

7. A compression system as set forth in claim 1 and including a subcooler expansion device upstream of said subcooler.

8. A compression system as set forth in claim 1 and including a check valve posed between said subcooler and said second suction inlet.

9. A method of selectively boosting the capacity of a vapor compression system having a single stage compressor, a condenser, an expansion valve and an evaporator comprising the steps of:

providing first and second sections to said compressor said first and second sections connected in parallel with each having a suction inlet and both discharging to a single discharge port;

providing a subcooler to receive a first portion of refrigerant from the condenser to cool a second portion of refrigerant from the condenser prior to its flow to the expansion valve; and providing for the flow of said first portion of refrigerant from said subcooler to said second section.

10. A method as set forth in claim 9 and including a step of delivering refrigerant from said expansion valve to said first section.

11. A method as set forth in claim 10 and including the step of applying multiple cylinders to compress the refrigerant being delivered to said first section.

12. A method as set forth in claim 10 and including the step of applying a single cylinder of said compressor to compress the refrigerant being delivered to said second section.

13. A vapor compression system for a refrigerated vehicle, comprising:

a single stage compressor for receiving a low pressure refrigerant vapor and delivering a high pressure refrigerant vapor, said compressor having first and second sections, connected in parallel with each having a suction inlet and both discharging to a single discharge port;

a condenser for receiving refrigerant vapor from said compressor and delivering liquid refrigerant;

an expansion valve for receiving at least a portion of said liquid refrigerant and converting it to a low pressure refrigerant vapor;

an evaporator for receiving low pressure refrigerant vapor from said expansion valve and delivering higher temperature refrigerant vapor to said first section; and a subcooler for receiving a portion of said liquid refrigerant from said condenser to subcool said portion of said liquid refrigerant passing to said expansion valve, said subcooler being fluidly connected to said compressor second section.

14. A system as set forth in claim 13 wherein said subcooler is connected to selectively provide for the flow of refrigerant to said second section.

15. A system as set forth in claim 13 wherein said first section has multiple reciprocating cylinders.

16. A system as set forth in claim 13 wherein said first section has at least one unloading circuit.

17. A system as set forth in claim 13 wherein said second section includes a single reciprocating cylinder.

* * * * *

UNITED STATES PATENT AND TRADEMARK OFFICE

CERTIFICATE OF CORRECTION

PATENT NO. : 6,820,434 B1
DATED : November 23, 2004
INVENTOR(S) : Gutheim et al.

It is certified that error appears in the above-identified patent and that said Letters Patent is hereby corrected as shown below:

Column 5,
Line 22, after the word "section" the phrase "of said compressor" should be omitted.

Signed and Sealed this

Fifteenth Day of February, 2005

JON W. DUDAS
*Director of the United States Patent and Trademark Office*